US008550600B2

(12) United States Patent
Katsuki et al.

(10) Patent No.: US 8,550,600 B2
(45) Date of Patent: Oct. 8, 2013

(54) LIQUID EJECTING APPARATUS

(75) Inventors: Kiyoteru Katsuki, Azumino (JP); Yoichi Yamada, Shiojiri (JP); Masaru Kobashi, Matsumoto (JP); Daisuke Matsumoto, Matsumoto (JP); Yasunori Koike, Matsumoto (JP); Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

(21) Appl. No.: 12/944,070

(22) Filed: Nov. 11, 2010

(65) Prior Publication Data

US 2011/0122200 A1 May 26, 2011

(30) Foreign Application Priority Data

Nov. 26, 2009 (JP) ..... 2009-268685

(51) Int. Cl.
*B41J 2/06* (2006.01)

(52) U.S. Cl.
USPC ..... 347/55; 347/54

(58) Field of Classification Search
USPC ..... 347/54, 55
See application file for complete search history.

(56) References Cited

U.S. PATENT DOCUMENTS

| | | | | |
|---|---|---|---|---|
| 7,735,975 | B2 * | 6/2010 | Endo et al. | 347/68 |
| 2007/0091146 | A1 | 4/2007 | Endo et al. | |

FOREIGN PATENT DOCUMENTS

| | | |
|---|---|---|
| JP | 2003-165230 | 6/2003 |
| JP | 2007-118318 | 5/2007 |
| JP | 2007-118320 | 5/2007 |
| JP | 2007-118321 | 5/2007 |
| JP | 2008-213255 | 9/2008 |

* cited by examiner

*Primary Examiner* — Kevin S Wood
(74) *Attorney, Agent, or Firm* — Workman Nydegger

(57) ABSTRACT

A liquid ejecting apparatus includes a liquid ejection unit that ejects a liquid onto an ejection target medium, a conductive brush provided adjacent to the liquid ejection unit and whose tip opposes the ejection target medium, and a same potential formation unit that sets the conductive brush and a predetermined portion of the liquid ejection unit to the same potential.

7 Claims, 7 Drawing Sheets

LIQUID EJECTING APPARATUS

BACKGROUND

1. Technical Field

The present invention relates to liquid ejecting apparatuses as exemplified by facsimile devices, printers, or the like.

2. Related Art

The following describes an ink jet printer as an example of a liquid ejecting apparatus. An ink jet printer has a support member (also called a platen) in a location that is opposite to an ink jet recording head, and is configured so that the distance between the ink jet recording head and the recording paper is defined by supporting the recording paper using the support member.

In recent ink jet printers, a trend toward smaller ink droplets is progressing with the aim of further improving the quality of recording, and ink droplets have been reduced in size to, for example, approximately several pls each. For this reason, the mass of the ink droplets is extremely low, and thus when ink droplets are ejected from the ink jet recording head onto the recording paper, some of the ink droplets turn into mist and float rather than landing upon the recording paper, which has caused a variety of problems. In addition, in so-called "borderless recording", in which recording is carried out without leaving margins on the four sides of the recording paper, the aforementioned floating mist phenomenon is even more evident due to ink droplets being ejected into regions that are outside of the edges of the recording paper.

Accordingly, techniques have been proposed in the past in which potential differences are applied between the ink jet recording head, the recording paper, and the support member, instigating Coulomb force on the ink droplets by generating an electrical field, thus pulling the ink droplets back toward the recording paper, as disclosed in JP-A-2007-118321 and JP-A-2007-118318.

Meanwhile, increases in speeds are advancing in recent ink jet printers, particularly in business applications, and thus the speed at which paper is transported has increased significantly as compared to the past. Furthermore, in so-called serial type ink jet printers, in which recording is carried out while the ink jet recording head moves in the direction that is perpendicular to the paper transport direction, head scans (recording) are executed while the paper is stopped, and thus it is necessary to further increase the paper transport speed in order to prevent a drop in throughput.

In addition, recent ink jet printers capable of executing recording with extremely high throughput using what is known as a line head, or a fixed-type ink jet recording head that does not perform scans (that is, does not move), have been proposed. With such ink jet printers, the recording paper is transported along a paper transport path within the apparatus at an extremely high speed.

However, it has been discovered that the following problems arise due to such an increase in the transport speed of the recording paper. First, paper particles produced when cutting the paper adhere to the edges of the recording paper, and in the case where the potential between the three elements of the recording paper, the support member (platen), and the ink jet recording head (collectively called the "recording unit constituent elements" hereinafter) is not controlled, the paper particles that had been adhering to the recording paper fly toward the ink jet recording head and adhere thereto due to the electrical field that has arisen between the recording unit constituent elements. This flight of paper particles is even more apparent in the case where the recording paper is transported at a high speed because vibrations, shocks of collisions, and so on that occur during the paper transport are more pronounced.

In addition, frictional electrification, separation electrification, and the like become apparent due to friction between pieces of recording paper that are held in a paper cassette, sliding/contact between the constituent elements of the paper transport path (for example, edge guides, transport rollers, or the like) and the recording paper, which results in the recording unit constituent elements being charged to a higher degree. As a result, the electrical field that is formed between the recording unit constituent elements grows stronger and the charge of the paper particles itself is also strengthened, and due to this, the Coulomb force that acts on the paper particles grows, causing the adherence of the paper particles to the ink jet recording head to become even more pronounced.

Meanwhile, even in the case where the paper particles themselves are not charged, if the paper particles that have flown are located within the electrical field, an electrical charge bias will occur in the paper particles due to induced polarization or electrostatic induction, which will pull the paper particles toward the ink jet recording head.

FIG. 7 is a descriptive diagram illustrating this problematic point, where the numeral 160 indicates an ink jet recording head, the numeral 160*a* indicates a nozzle plate, the numeral 170 indicates a support member (platen), and the numerals 170*a* indicate ribs formed in the support member 170. In addition, the letter P indicates recording paper, the letters Pe indicate an edge of the paper, and the letter d indicates paper particles. Furthermore, the "plus" and "minus" signs in circles indicate charge polarities.

The recording paper P is de-electrified by a de-electrifying brush or the like, and thus the paper particles d that adhere to the recording paper P are not charged. However, as shown in the enlargement diagram in FIG. 7 that illustrates the paper particles d, in the (exemplary) case where the nozzle plate 160*a* is positively charged and the support member 170 is negatively charged, a negative charge appears on the nozzle plate side of the paper particles d and a positive charge appears on the support member side of the paper particles d due to the induced polarization (in the case where the paper particles d have dielectric properties) or the electrostatic induction (in the case where the paper particles d have conductive properties). Accordingly, the paper particles d are pulled toward either the nozzle plate 160*a* or the support member 170.

Paper particles d adhering to the ink jet recording head 160 can lead to missing dots due to the paper particles d directly obstructing the nozzle openings or due to paper particles d moving into the nozzle openings when the nozzle surface are cleaned (wiped).

In addition to the paper particles physically obstructing the nozzle openings in this manner, there are also cases where filler such as calcium carbonate that is contained in the paper particles reacts with the moisture in the ink and causes thickening, which inhibits vibrations in the meniscuses at the nozzle openings and interferes with the ejection of ink droplets. Accordingly, preventing paper particles from adhering to the ink jet recording head is extremely important in order to obtain a suitable recording quality in an ink jet printer.

The aforementioned JP-A-2007-118321 and JP-A-2007-118318 propose techniques in which, as described earlier, potential differences are applied between the ink jet recording head, the recording paper, and the support member (the recording unit constituent elements), instigating Coulomb force on the ink droplets by generating an electrical field and pulling the ink droplets back toward the recording paper. Accordingly, if the paper particles are considered physically same as the ink droplets, it is thought that controlling the electrical field pulls the paper particles toward the recording paper, which will make it possible to prevent the paper particles from adhering to the ink jet recording head.

However, the cellulose fibers and filling materials of which the paper particles are composed are easily charged to either positive or negative polarities in terms of triboelectric series, and thus even if the paper particles are prevented from flying toward the ink jet recording head by forming an electrical field in a specific direction between the recording unit constituent elements, it is not possible to prevent the paper particles that have been charged to the opposite polarity from flying toward the ink jet recording head.

It should be noted that JP-A-2003-165230 discloses a recording apparatus configured so that air ducts are provided in the periphery of a nozzle plate and humidified air is ejected from the air ducts during recording and when standing by for recording as one way of preventing paper particles, dust, and the like from adhering to the vicinity of a nozzle unit in an ink jet recording head. However, with such a configuration, the complexity of the configuration leads to a larger apparatus size and an increase in costs, and there is also the risk that the airflow itself will cause paper particles to adhere to the recording head.

SUMMARY

An advantage of some aspects of the invention is to prevent, with certainty, foreign objects such as paper particles, dust, or the like (called "paper particles and the like" hereinafter) from adhering to an ink jet recording head.

A first aspect of the invention includes a liquid ejection unit that ejects a liquid onto an ejection target medium; a conductive brush provided adjacent to the liquid ejection unit and whose tip opposes the ejection target medium; and a same potential formation unit that sets the conductive brush and a predetermined portion of the liquid ejection unit to the same potential.

According to this aspect of the invention, the conductive brush, whose tip opposes the ejection target medium, is provided in a position that is adjacent to the liquid ejection unit, and is set to the same potential as the predetermined portion of the liquid ejection unit by the same potential formation unit, and thus the ejection target medium and paper particles and the like that have adhered thereto are set to a potential that is close to or the same potential as the predetermined portion of the liquid ejection unit; as a result, an electrical field between the ejection target medium and the paper particles and the like that have adhered thereto and the liquid ejection unit is extremely weak or is hardly formed at all (for the sake of convenience, thus state will be called a "non-electrical field state" hereinafter).

Accordingly, no electrical field is formed between the ejection target medium and the liquid ejection unit, and thus no Coulomb force is exerted on the paper particles and the like, which makes it possible to prevent the paper particles and the like from flying toward and adhering to the liquid ejection unit. This also achieves an effect in which the liquid ejection unit is shielded by the conductive brush, which makes it possible to physically block paper particles and the like that fly toward the liquid ejection unit.

A second aspect of the invention is the first aspect, in which the conductive brush is provided so that the tip of the conductive brush makes contact with the ejection target medium.

According to this aspect of the invention, the conductive brush is provided so that its tip makes contact with the ejection target medium, and thus it is possible to induce, with certainty, the potential of the ejection target medium to the same potential as the liquid ejection unit.

Meanwhile, the tip of the brush making contact with the ejection target medium makes it possible to eliminate paper particles and the like that is present upon the ejection target medium. Furthermore, the tip of the brush makes it possible to prevent the ejection target medium from lifting, which can contribute to preventing a drop in the liquid ejection quality by stabilizing the gap between the ejection target medium and the liquid ejection unit.

A third aspect of the invention is the first aspect, in which the conductive brush is provided so that the tip of the conductive brush does not make contact with the ejection target medium.

According to this aspect of the invention, the conductive brush is provided so that its tip does not make contact with the ejection target medium, which makes it possible to prevent the tip of the brush from damaging the surface of the ejection target medium. In particular, if the tip of the brush makes contact with the surface of the ejection target medium onto which liquid has already been ejected, there is the risk of the liquid adhering to the tip of the brush and soiling the ejection target medium; however, this aspect can prevent such a problem from occurring.

This is particularly useful in a so-called serial type apparatus in which the liquid ejection unit ejects liquid while moving in the direction that is perpendicular to the transport direction of the ejection target medium. Furthermore, this aspect of the invention is useful in the case where liquid is ejected onto both sides of the ejection target medium and the ejection target medium is backfed after liquid has been ejected onto the front surface of the ejection target medium.

A fourth aspect of the invention is the second or third aspect, in which the conductive brush is provided upstream from the liquid ejection unit in a transport direction of the ejection target medium.

According to this aspect of the invention, the conductive brush is provided upstream from the liquid ejection unit in the transport direction of the ejection target medium, and thus the potential of the ejection target medium is set to close to or the same potential as the potential of the predetermined portion of the liquid ejection unit prior to the ejection of the liquid. Accordingly, the non-electrical field state can be formed with certainty in a liquid ejection region, thus making it possible to prevent, with more certainty, the paper particles and the like from flying toward and adhering to the liquid ejection unit.

A fifth aspect of the invention is the third aspect, in which the conductive brushes are provided on both sides of the liquid ejection unit in a direction that is perpendicular to the transport direction of the ejection target medium.

According to this aspect of the invention, the conductive brushes are provided on both sides of the liquid ejection unit in the direction that is perpendicular to the transport direction of the ejection target medium, which makes it possible to block the paper particles and the like from flying toward the liquid ejection unit from the edges of the ejection target medium, where adherence of the paper particles and the like is pronounced.

A sixth aspect of the invention is the first aspect, in which the conductive brushes are provided at least upstream from the liquid ejection unit in the transport direction of the ejection target medium and on both sides of the liquid ejection unit in the direction that is perpendicular to the transport direction, the conductive brush is provided upstream in the transport direction so that the tip of the conductive brush makes contact with the ejection target medium, and the conductive brushes are provided on both sides of the direction that is perpendicular to the transport direction so that the tips of the conductive brushes do not make contact with the ejection target medium.

According to this aspect of the invention, the conductive brush is provided upstream in the ejection target medium transport direction so that its tip makes contact with the ejection target medium, and thus it is possible to induce, with certainty, the potential of the ejection target medium to the same potential as the liquid ejection unit in the liquid ejection region. Meanwhile, the tip of the brush making contact with the ejection target medium makes it possible to eliminate paper particles and the like that is present upon the ejection target medium. Furthermore, the tip of the brush makes it possible to prevent the ejection target medium from lifting, which can contribute to preventing a drop in the liquid ejection quality by stabilizing the gap between the ejection target medium and the liquid ejection unit.

In addition, the conductive brushes provided on both sides in the direction that is perpendicular to the ejection target medium transport direction do not make contact with the ejection target medium, which makes it possible to prevent the surface of the ejection target medium from being damaged. In particular, if the tip of the brush makes contact with the surface of the ejection target medium onto which liquid has already been ejected, there is the risk of the liquid adhering to the tip of the brush and soiling the ejection target medium; however, this aspect can prevent such a problem from occurring.

A seventh aspect of the invention is the first through sixth aspects, further including an ejection target medium support unit that is disposed so as to oppose the liquid ejection unit and that supports the ejection target medium; the same potential formation unit sets a predetermined portion of the ejection target medium support unit, in addition to the conductive brush and the predetermined portion of the liquid ejection unit, to the same potential.

According to this aspect of the invention, the same potential formation unit sets the predetermined portion of the ejection target medium support unit to the same potential in addition to the conductive brush and the predetermined portion of the liquid ejection unit, and thus in the liquid ejection region, in which liquid is ejected onto the ejection target medium, almost no electrical field is formed between the liquid ejection unit, the ejection target medium, and the ejection target medium support unit; this makes it possible to prevent, with more certainty, the paper particles and the like from flying toward and adhering to the liquid ejection unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
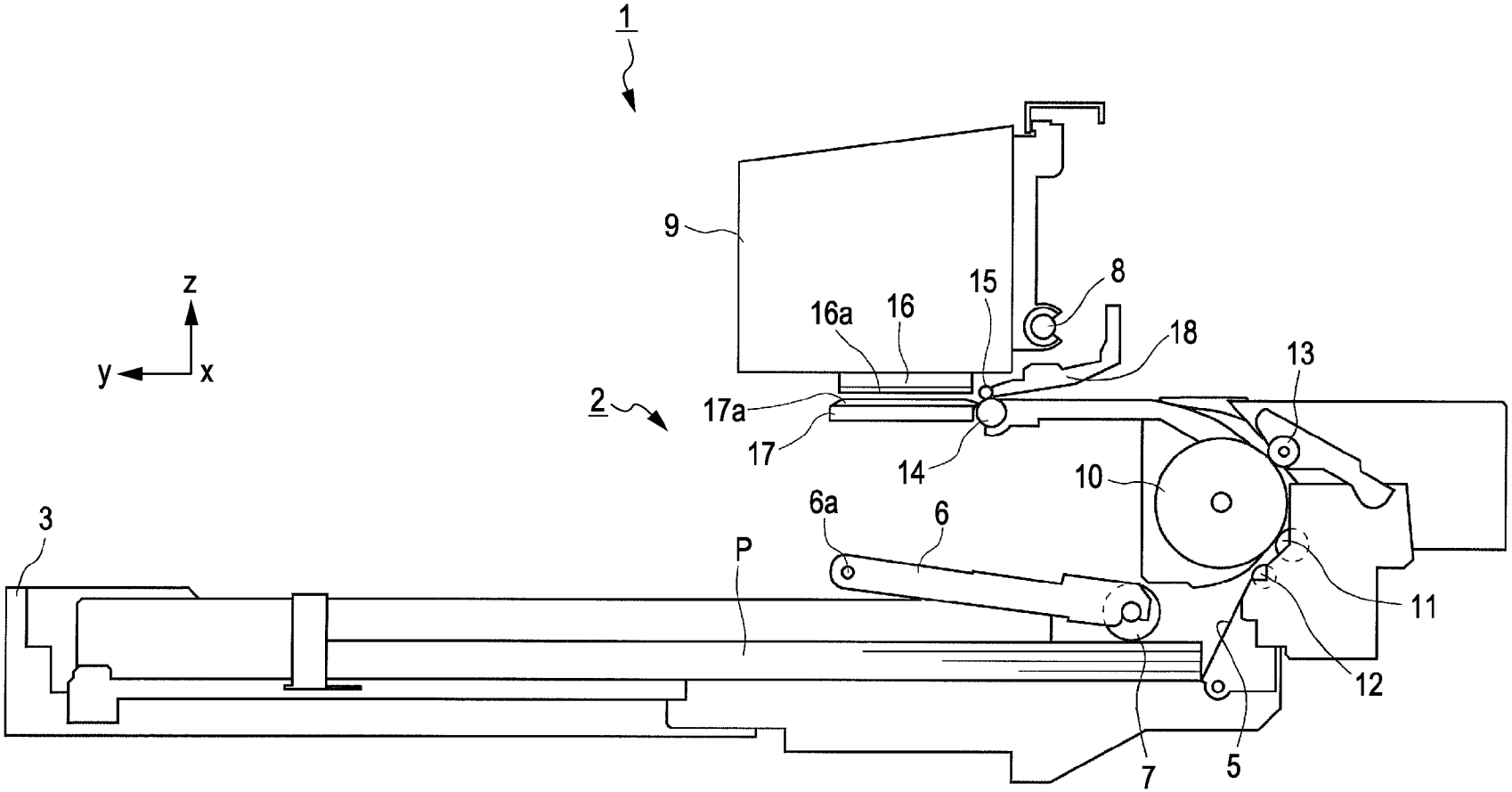
FIG. 1 is a schematic cross-sectional side view that illustrates a paper transport path in a printer according to the invention.
Figure 2:
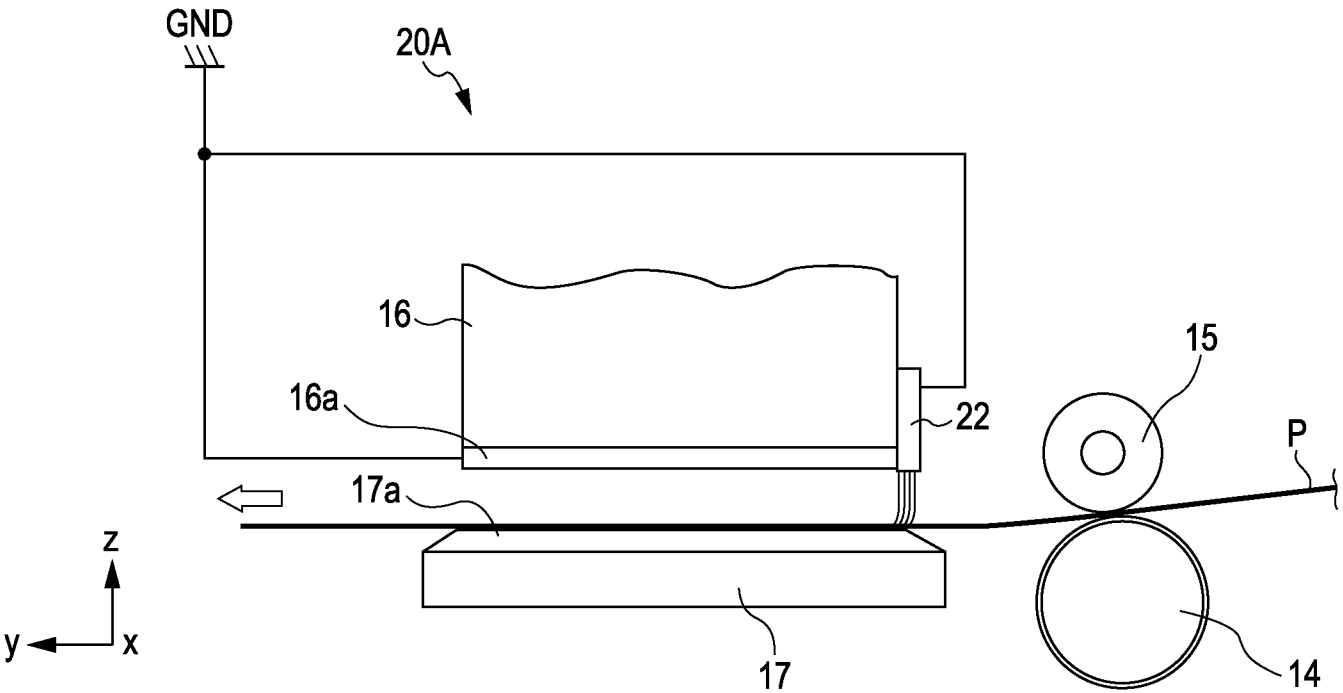
FIG. 2 is a side view illustrating a recording execution region of a printer according to the invention.
Figure 3:
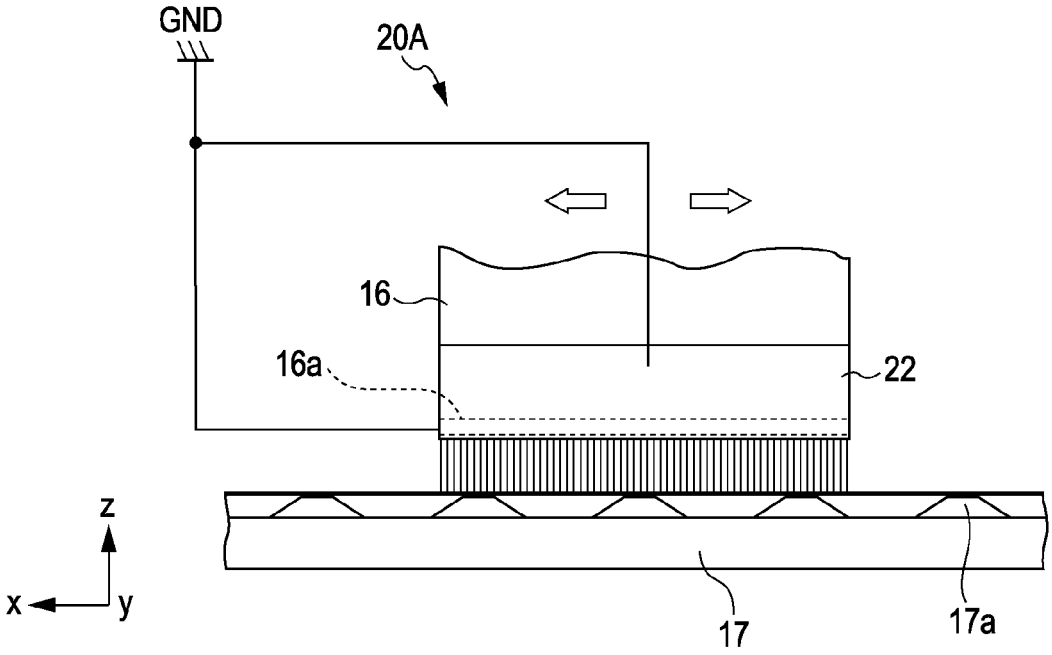
FIG. 3 is a front view illustrating a recording execution region of a printer according to the invention.
Figure 4:
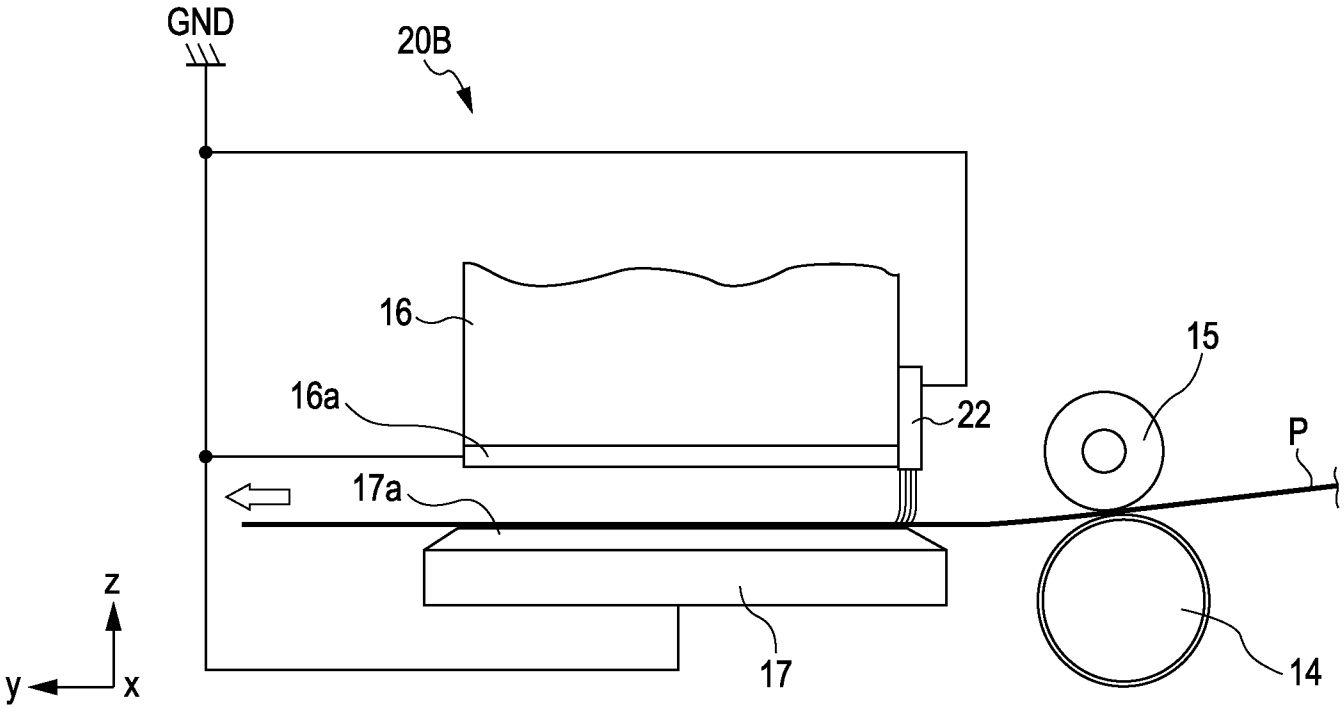
FIG. 4 is a side view illustrating a recording execution region of a printer according to another embodiment of the invention.
Figure 5:
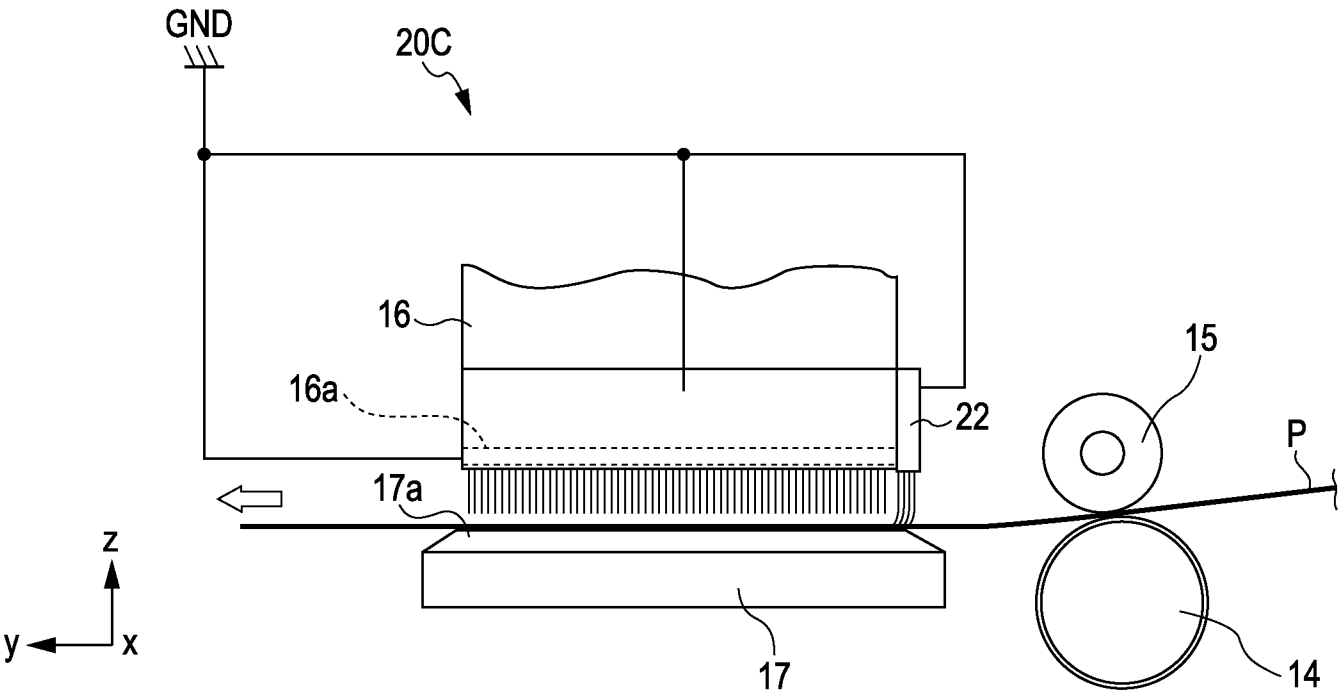
FIG. 5 is a side view illustrating a recording execution region of a printer according to another embodiment of the invention.
Figure 6:
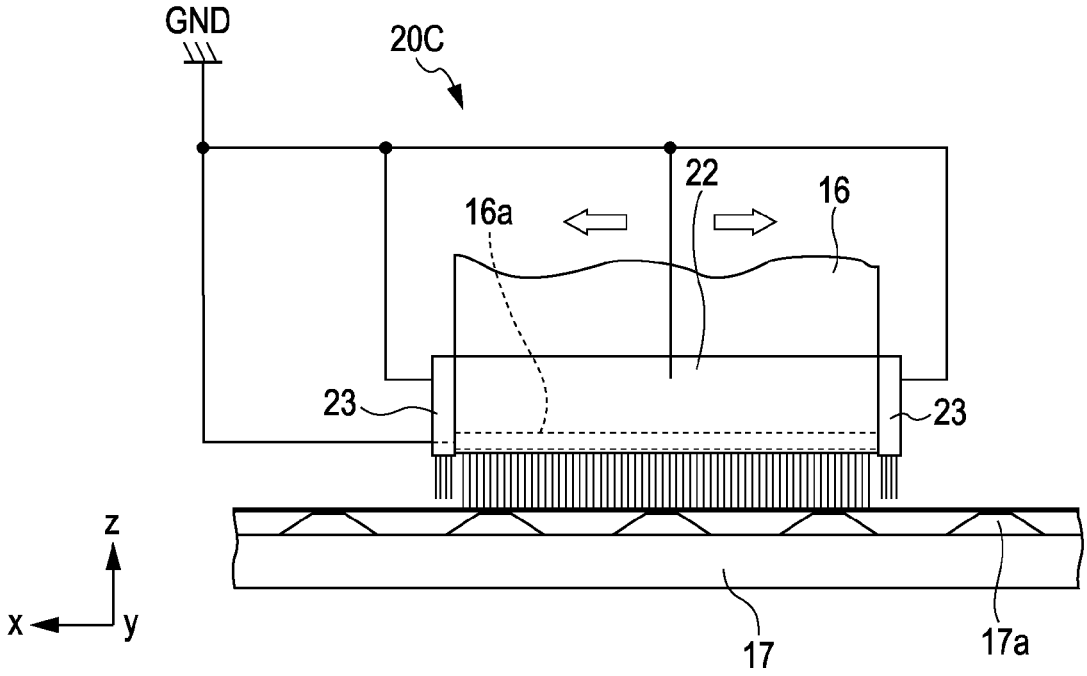
FIG. 6 is a front view illustrating a recording execution region of a printer according to another embodiment of the invention.
Figure 7:
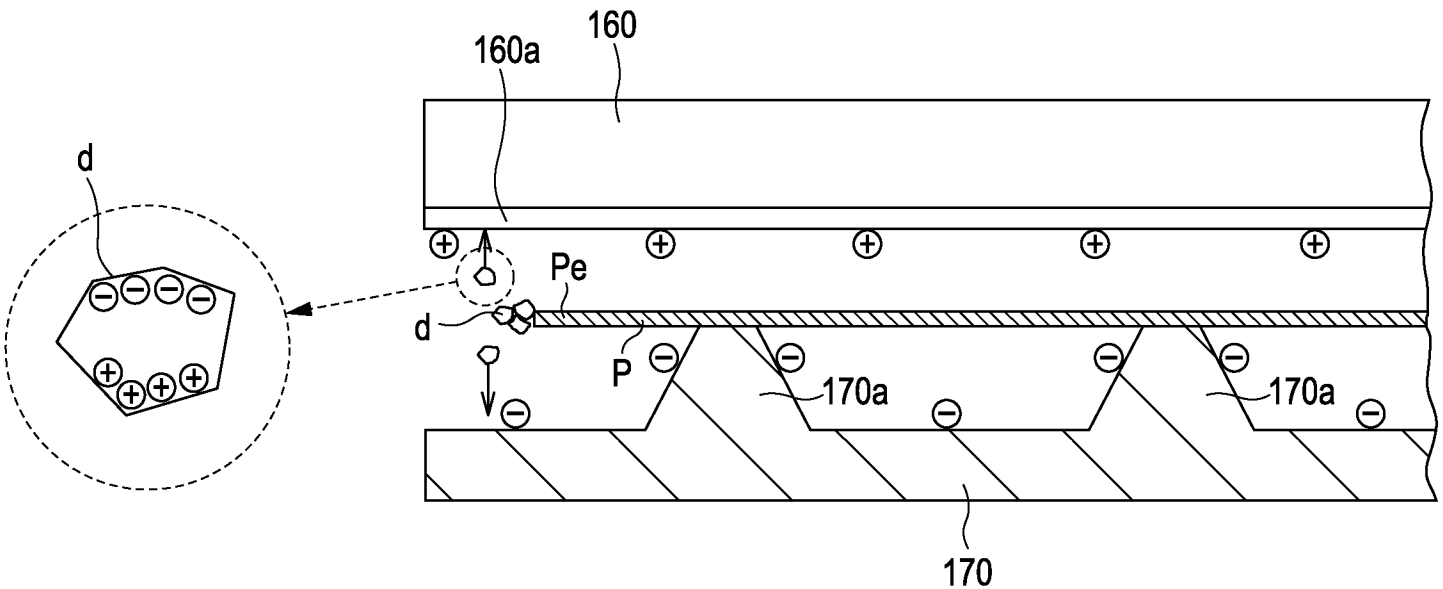
FIG. 7 is a descriptive diagram illustrating a problematic point in related art.

Hereinafter, embodiments of the invention will be described with reference to the drawings. Here, FIG. 1 is a schematic cross-sectional side view that illustrates a paper transport path in an ink jet printer 1 according to the invention, FIG. 2 is a side view illustrating a recording execution region of the ink jet printer 1, and FIG. 3 is a front view illustrating the recording execution region of the ink jet printer 1. Meanwhile, FIGS. 4 and 5 are side views illustrating a recording execution region in an ink jet printer according to other embodiments of the invention, whereas FIG. 6 is a front view illustrating the recording execution region of an ink jet printer according to another embodiment of the invention. Note that FIGS. 1 through 6 are illustrated according to an x-y-z coordinate system, where the y axis represents a paper transport direction, the x axis represents the direction that is perpendicular to the paper transport direction (that is, a paper width direction), and the z axis illustrates an apparatus height direction.

Hereinafter, the overall configuration of the ink jet printer 1 will be generally described with reference to FIG. 1. The ink jet printer 1 includes a paper feed device 2 provided in the base of the apparatus, and is configured so as to carry out recording by dispatching recording paper P, serving as an example of an ejection target medium, from the paper feed device 2, rolling and inverting the recording paper P using an intermediate roller 10, and feeding the recording paper P to an ink jet recording head 16 serving as a liquid ejection unit.

To be more specific, the paper feed device 2 includes a paper cassette 3, a pickup roller 7, the intermediate roller 10, a retard roller 11, and guide rollers 12 and 13. A separation angled surface 5 is provided in a location that is opposite to the leading edge of the recording paper P held in the paper cassette 3, which is removable from the paper feed device 2; the leading edge of the recording paper P, which is discharged by the pickup roller 7, is fed downstream while sliding along the separation angled surface 5, and thus the topmost recording paper P, which is to be fed, and the successive pieces of recording paper P, which would be fed along therewith, are separated from each other in preparation.

The pickup roller 7 of which a paper feed unit is configured is axially supported by a pivoting member 6 capable of pivoting in the clockwise direction or the counterclockwise direction in FIG. 1 central to a pivoting shaft 6*a*, and is provided so as to be rotationally driven by the driving force of a driving motor (not shown). During paper feeding, the pickup roller 7 rotates in contact with the topmost recording paper P held in the paper cassette 3, thus discharging the topmost recording paper P from the paper cassette 3.

Next, the recording paper P discharged from the paper cassette 3 enters into a curved inversion section. The intermediate roller 10, the retard roller 11, and the guide rollers 12 and 13 are provided in this curved inversion section.

The intermediate roller 10 is a large-diameter roller that forms the inner side of a curved inversion path that curves and inverts the recording paper P, and is rotationally driven by a driving motor that is not shown in FIG. 1. The intermediate roller 10 transports the recording paper P downstream with the recording paper P wrapped thereupon by rotating in the counterclockwise direction in FIG. 1.

The retard roller 11 is provided so as to be capable of pressing against and distancing from the intermediate roller 10 with a predetermined rotational friction resistance applied thereto, and by nipping the recording paper P between the retard roller 11 and the intermediate roller 10, the topmost recording paper P that is to be fed is separated from the successive pieces of recording paper P, which would be fed along therewith.

Note that a paper return lever (not shown) is provided in the paper feed path in this vicinity, and the configuration is such that the successive pieces of recording paper P whose advancement has been stopped by the retard roller 11 are returned to the paper cassette 3 by this paper return lever.

The guide rollers 12 and 13 are rollers that are capable of free rotation, and of these, the guide roller 13 nips the paper P between itself and the intermediate roller 10, thus assisting the paper transport performed by the intermediate roller 10.

The foregoing has described the configuration of the paper feed device 2, and the ink jet printer that includes this paper feed device 2 is furthermore provided with a paper transport unit, including a transport driving roller 14 and a transport slave roller 15, located downstream from the intermediate roller 10. The transport driving roller 14 is rotationally driven by a driving motor (not shown), and the transport slave roller 15 nips the recording paper P between itself and the transport driving roller 14, thus carrying out slave rotation in accordance with the transport of the recording paper P. Note that the numeral 18 indicates an upper guide member that supports the transport slave roller 15 in a freely-rotatable state.

The region downstream from the transport driving roller 14 is a recording region in which recording onto the recording paper P is executed; in this region, the ink jet recording head 16 serving as the liquid ejection unit and a support member 17 that regulates the distance between the recording paper P and the ink jet recording head 16 by supporting the recording paper P are disposed facing each other.

The numeral 16*a* indicates a metallic nozzle plate that forms a first side of the ink jet recording head 16 facing the support member 17 and in which multiple ink ejection nozzles (not shown) are formed. Meanwhile, the numeral 17*a* indicates a rib formed in the support member 17 and extending along the paper transport direction (the y direction; the right-left direction in FIG. 1); multiple ribs 17*a* are formed in the paper width direction (the x direction; the paper surface front-rear direction in FIG. 1) with an appropriate interval provided therebetween (see also FIG. 3), and the recording paper P is supported by the ribs 17*a*.

The ink jet recording head 16 is mounted in the base of a carriage 9, and the configuration is such that the carriage 9 is moved back and forth in the paper width direction (the x direction) by a motor (not shown) while being guided by a carriage guide shaft 8 that extends in the paper width direction (the x direction; the paper surface front-rear direction in FIG. 1). Recording onto the recording paper P is completed by repeatedly executing, in alteration, ink jet recording head 16 scans (that is, ejection of ink from the ink jet recording head 16 while the carriage 9 moves) and paper transport operations carried out by the transport driving roller 14 and the transport slave roller 15.

It should be noted that although the ink jet printer 1 is, in this embodiment, a so-called serial-type, in which the ink jet recording head 16 ejects ink while moving in the paper width direction, the ink jet printer 1 is not limited thereto, and the invention can also be applied as appropriate in an ink jet printer in which the ink jet recording head 16 is a so-called line head formed so as to cover the width of the paper, the ink jet printer thus being capable of executing recording simply by moving the recording paper P in the transport direction (the y direction) without moving the recording head back and forth in the paper width direction.

Recording is thus carried out on the recording paper P between the ink jet recording head 16 and the support member 17 (in the recording region), after which the recording paper P is discharged to the exterior of the apparatus by a discharge unit (not shown in FIG. 1).

The foregoing has described the overall configuration of the ink jet printer 1; hereinafter, a characteristic configuration of the recording region will be described with reference to FIGS. 2 through 6.

FIGS. 2 and 3 illustrate a first embodiment of the invention. The numeral 22 indicates a conductive brush attached so as to be adjacent to the ink jet recording head 16, and as shown in FIGS. 2 and 3, the conductive brush 22 is provided upstream from the ink jet recording head 16 in the paper transport direction. In addition, the conductive brush 22 is formed at a width that is capable of spanning almost the entirety of the ink jet recording head 16 in the direction perpendicular to the paper transport direction (that is, the paper width direction).

The conductive brush 22 is provided so that its leading edge faces the recording paper P, and in this embodiment, the amount by which the brush protrudes is set so that the tip of the brush makes contact with the recording paper P. Note that it is preferable for the tip of the brush to make contact with the recording paper P in a manner in which the brush does not damage the recording surface of the recording paper P, and it is also preferable to adjust the amount by which the brush protrudes so that the tip of the brush does not press excessively upon the recording paper P.

Next, the numeral 20A indicates a same potential formation unit. The same potential formation unit 20A is a unit that, in this embodiment, sets the conductive brush 22 and the nozzle plate 16*a* at the same potential. To be more specific, the conductive brush 22 is formed of a conductive material in which the brush has a surface resistivity of, for example, $10^2$ to $10^8\Omega$ per square, and the nozzle plate 16*a* is a metallic plate; these two elements are connected to a ground.

Accordingly, as a result, the recording paper P that makes contact with the tip of the brush in the conductive brush 22 and the nozzle plate 16*a* are at a ground (0) potential. In other words, the recording paper P (and paper particles and the like that adhere thereto) and the nozzle plate 16*a* are at the same potential, resulting in a state in which no electrical field is formed between the two (that is, a non-electrical field state).

By being configured as described in the foregoing, no Coulomb force is exerted on the paper particles and the like that has adhered to the recording paper P in the recording region of the ink jet printer 1, and it is thus possible to prevent, with more certainty, the paper particles and the like from flying toward and adhering to the nozzle plate 16*a*.

In addition, the conductive brush 22 makes it possible to achieve an effect in which the nozzle plate 16*a* is shielded, thus making it possible to physically block paper particles and the like that fly toward the nozzle plate 16*a*. Furthermore, the tip of the brush making contact with the recording paper P makes it possible to induce the potential of the recording paper P to the 0 potential with certainty.

Further still, the tip of the brush making contact with the recording paper P makes it possible to remove paper particles and the like that are on the paper, and the paper can be prevented from lifting by the tip of the brush; this makes it possible to stabilize the gap between the recording paper P and the ink jet recording head 16, thus preventing a drop in the recording quality.

Next, FIG. 4 illustrates a second embodiment of the invention. The differences between this embodiment and the aforementioned first embodiment are in a same potential formation unit indicated by the numeral 20B and that the same potential formation unit 20B sets the support member 17 to the same potential in addition to the conductive brush 22 and the nozzle plate 16*a*. Note that the support member 17 is formed so as to be conductive, with a surface resistivity of, for example, $10^2$ to $10^8\Omega$ per square, by mixing a conductive material such as a metal, carbon, or the like into a resin material.

By being configured as described in the foregoing, with the second embodiment, an electrical field is not formed between the nozzle plate 16*a*, the recording paper P, and the support member 17, and thus it is possible to prevent, with more certainty, paper particles and the like from flying toward and adhering to the nozzle plate 16*a*.

Next, FIGS. 5 and 6 illustrate a third embodiment of the invention. This embodiment differs from the first embodiment in that conductive brushes 23 and 23 have further been added and the numeral 20C indicates a same potential formation unit. To be more specific, in addition to the conductive brush 22 that is upstream from the ink jet recording head 16 in the paper transport direction, conductive brushes 23 are provided on both sides of the ink jet recording head 16 in the paper width direction (the brushes themselves are configured in the same manner as the conductive brush 22).

The conductive brushes 22 and 23 are connected to a ground along with the nozzle plate 16*a*. Note that the amount by which the conductive brushes 23 protrude is set so that the tips of the brushes do not make contact with the recording paper P.

By being configured as described in the foregoing, in addition to the effects of the conductive brush 22 provided upstream from the ink jet recording head 16 described earlier, the conductive brushes 23 provided on both sides of the ink jet recording head 16 make it possible to effectively block paper particles and the like from flying toward the nozzle plate 16*a* from the edges of the paper, where the adherence of paper particles and the like is more marked.

In addition, because the tips of the conductive brushes 23 do not make contact with the recording paper P, it is possible to prevent the surface of the recording paper P from being damaged. In particular, if the tip of a brush makes contact with the surface of paper onto which ink has already been ejected, there is the risk of the ink adhering to the tip of the brush and soiling the recording surface; however, this embodiment prevents such a problem from occurring. Note that even if the tip of the brush does not make contact with the recording paper P in this manner, the paper potential can still be induced to a desired potential due to the tip of the brush being close to the recording surface.

Variations on Above Embodiments

(1) Same Potential Formation Unit

In the aforementioned embodiments, the conductive brushes (22 and 23), nozzle plate 16*a*, or those elements plus the support member 17, are set to the same potential by the same potential formation units 20A to 20C; however, in the case where these constituent elements are set to the same potential, any desired potential of any desired polarity may be applied, instead of limiting the potential to a ground connection. In other words, setting the potential to be the same between two constituent elements results in no electrical field being formed therebetween, which is effective against the flying of paper particles.

(2) Conductive Brushes

In the aforementioned embodiments, and particularly, in the third embodiment illustrated in FIGS. 5 and 6, conductive brushes are provided at least upstream from the ink jet recording head 16 in the paper transport direction and on both sides in the paper width direction; however, further providing a conductive brush downstream from the ink jet recording head 16 in the paper transport direction makes it possible to enclose the ink jet recording head 16 with conductive brushes. In this case, it is preferable to provide the conductive brush that is downstream in the paper transport direction so that the tip thereof does not come into contact with the recording surface, in order to prevent the tip of the brush from soiling a recording surface onto which recording has already been carried out. Furthermore, the conductive brush (22) can be provided upstream in the paper transport direction so that the tip thereof does not come into contact with the recording surface.

In addition, because a gap varies between the position of the recording surface and the position of the tip of the conductive brush depending on the thickness of the recording paper P, it is preferable, particularly in the case where the tip of the brush is brought into contact with the recording surface, to set the amount by which the tip of the brush protrudes having taken into consideration the thinnest of the multiple types of recording paper P that are assumed to be used. Meanwhile, in the case where the tip of the brush is not brought into contact with the recording surface, it is preferable to set the amount by which the tip of the brush protrudes having taken into consideration the thickest of the multiple types of recording paper P that are assumed to be used.

Furthermore, although conductive brushes are provided for the ink jet recording head 16 that moves in the paper width direction in the aforementioned embodiments, it goes without saying that it is also possible to provide such conductive brushes for a so-called line head that does not move in the paper width direction.

(3) Nozzle Plate

In the aforementioned embodiments, a water-repellent film can be provided on the surface of the nozzle plate 16*a*. Here, using a conductive water-repellent film makes it possible to suppress the water-repellent film from becoming charged, which in turn makes it possible to suppress paper particles and the like from adhering to the nozzle plate 16*a* and control, with certainty, the potential in the nozzle plate.

Furthermore, if an insulative water-repellent film is used, the image force of the nozzle plate 16*a*, which is formed of a metal such as SUS (that is, a phenomenon in which when paper particles and the like that is charged approaches the nozzle plate, an opposite charge arises in the nozzle plate, thus drawing the paper particles and the like and the nozzle plate toward each other), can be reduced, thus making it possible to prevent paper particles and the like that has been stirred up in the vicinity of the nozzle plate from being pulled toward the nozzle plate 16*a*.

Note that it is preferable for a predetermined portion in the ink jet recording head 16 that applies or removes a predetermined potential (that is, controls the potential) to be closest to the support member 17 in the ink jet recording head 16, or in other words, to be the nozzle plate 16*a*, and more specifically, it is preferable for this predetermined portion to be the nozzle surface that opposes the support member 17. As a result, the potential of the nozzle surface that is closest to the recording paper P is controlled, thus making it possible to suppress a diffracted electrical field from the periphery as well as effectively prevent paper particles and the like from adhering to the nozzle surface. Note that the same applies to the support member 17, and thus in the case where a predetermined portion in the support member 17 is to undergo potential control, it is preferable for that portion to be the surface that opposes the nozzle plate 16*a*.

(4) Applying Charge to Ink Droplets

In the case where a predetermined potential has been applied to the nozzle plate 16*a*, the ink droplets are charged by an induced charge via the nozzle plate 16*a*. However, the ink droplets may be charged at any given location in an ink channel spanning from an ink holding chamber that holds the ink (for example, the ink cartridge or the like) to the nozzle plate 16*a*. For example, part or all of the inner wall of the ink holding chamber may be configured of a conductive member and a charge may then be applied to the ink via that inner wall.

Note that by applying the same potential as the conductive brush to the ink that serves as a liquid, the electrical field between the ink jet recording head 16 and the recording paper P can be made extremely weak, making it possible to achieve measures for preventing paper particles from adhering to the nozzle plate 16*a*. In other words, the nozzle plate 16*a*, for example, is not limited to a conductor such as a metal, and can be formed of a dielectric material such as silicon, an acryl, a polyimide, or the like. In such a case, if the potential of the ink within the head is not controlled, an electrical field caused by a difference in potentials between the ink within the head and the recording paper P will exert a strong influence on the paper particles, leading to situations where the paper particles fly toward the nozzle plate 16*a*. However, applying the same potential as the conductive brush to the ink within the head makes it possible to eliminate this problem.

In addition, in the case where the nozzle plate 16*a* is formed of a dielectric material, it is possible to employ, as a configuration for applying a potential to the ink within the head, a configuration in which only the ink channel portion of the nozzle plate (that is, the portions that make contact with the ink) is configured of a conductive material and the potential is applied to the ink via the conductive material. For example, in the case where the nozzle plate has a layered configuration, the ink channel portions may be configured of a conductive material in all of those layers, or the ink channel portions in at least one of those layers may be configured of a conductive material.

What is claimed is:

1. A liquid ejecting apparatus comprising:

a liquid ejection unit that ejects a liquid onto an ejection target medium, wherein the liquid ejection unit includes a metallic nozzle plate;

a conductive brush provided adjacent to the liquid ejection unit and whose tip opposes the ejection target medium, wherein the conductive brush and the metalize nozzle plate are each electrically connected to a ground; and a same potential formation unit that sets the conductive brush and a predetermined portion of the liquid ejection unit to the same potential through the connection of the conductive brush and the metallic nozzle plate to the ground.

2. The liquid ejecting apparatus according to claim 1, wherein the conductive brush is provided so that the tip of the conductive brush makes contact with the ejection target medium.

3. The liquid ejecting apparatus according to claim 1, wherein the conductive brush is provided so that the tip of the conductive brush does not make contact with the ejection target medium.

4. The liquid ejecting apparatus according to claim 2, wherein the conductive brush is provided upstream from the liquid ejection unit in a transport direction of the ejection target medium.

5. The liquid ejecting apparatus according to claim 3, wherein the conductive brushes are provided on both sides of the liquid ejection unit in a direction that is perpendicular to the transport direction of the ejection target medium.

6. The liquid ejecting apparatus according to claim 1, wherein the conductive brushes are provided at least upstream from the liquid ejection unit in a transport direction of the ejection target medium and on both sides of the liquid ejection unit in the direction that is perpendicular to the transport direction;

the conductive brush is provided upstream in the transport direction so that the tip of the conductive brush makes contact with the ejection target medium; and the conductive brushes are provided on both sides of the direction that is perpendicular to the transport direction so that the tips of the conductive brushes do not make contact with the ejection target medium.

7. The liquid ejecting apparatus according to claim 1, further comprising:

an ejection target medium support unit that is disposed so as to oppose the liquid ejection unit and that supports the ejection target medium, wherein the same potential formation unit sets a predetermined portion of the ejection target medium support unit, in addition to the conductive brush and the predetermined portion of the liquid ejection unit, to the same potential.

* * * * *